US010029390B2

(12) United States Patent
Eilola

(10) Patent No.: US 10,029,390 B2
(45) Date of Patent: Jul. 24, 2018

(54) METHOD AND APPARATUS FOR CASTING CONCRETE PRODUCTS

(71) Applicant: Elematic Oy Ab, Akaa (FI)

(72) Inventor: Jani Eilola, Lempaala (FI)

(73) Assignee: ELEMATIC OYJ, Akaa (FI)

( * ) Notice: Subject to any disclaimer, the term of this patent is extended or adjusted under 35 U.S.C. 154(b) by 426 days.

(21) Appl. No.: 14/734,054

(22) Filed: Jun. 9, 2015

(65) Prior Publication Data

US 2015/0352745 A1 Dec. 10, 2015

(30) Foreign Application Priority Data

Jun. 9, 2014 (FI) ..... 20145527

(51) Int. Cl.

| | |
|---|---|
| ***B28B 1/093*** | (2006.01) |
| ***B28B 1/14*** | (2006.01) |
| ***B28B 13/02*** | (2006.01) |
| ***E04G 21/02*** | (2006.01) |

(52) U.S. Cl.

CPC ..... *B28B 1/0935* (2013.01); *B28B 1/14* (2013.01); *B28B 13/026* (2013.01); *B28B 13/0215* (2013.01); *E04G 21/025* (2013.01)

(58) Field of Classification Search

CPC ..... B28B 1/0935; B28B 1/14; B28B 13/0215; B28B 13/026; B28B 1/08; E04G 21/025; B65D 88/66

USPC ..... 241/262, 264, 265, 283

See application file for complete search history.

(56) References Cited

U.S. PATENT DOCUMENTS

| | | | | |
|---|---|---|---|---|
| 2,174,348 | A * | 9/1939 | Damond | B65D 88/66 222/196 |
| 2,349,476 | A * | 5/1944 | Trickey | E04G 21/025 294/68.25 |
| 2,553,543 | A * | 5/1951 | Bodine, Jr. | F04B 43/088 137/533.11 |
| 2,702,559 | A * | 2/1955 | Bodine, Jr. | F02M 69/041 137/38 |
| 2,706,450 | A * | 4/1955 | Bodine, Jr. | F04B 53/146 166/177.1 |
| 2,798,645 | A * | 7/1957 | Keen | A01K 5/0208 222/226 |

(Continued)

FOREIGN PATENT DOCUMENTS

| | | |
|---|---|---|
| CN | 201729434 | 5/2011 |
| DE | 2408914 | 9/1975 |

(Continued)

OTHER PUBLICATIONS

EP Search Report for Patent App. No. 15169619.2 dated Nov. 18, 2015.

(Continued)

*Primary Examiner* — Matthew J Daniels
*Assistant Examiner* — Emmanuel S Luk
(74) *Attorney, Agent, or Firm* — Berggren LLP

(57) ABSTRACT

A method and an apparatus for casting concrete products by mold casting, where concrete mix is fed in a casting mold from a casting apparatus moved above the mold, and the concrete mix is vibrated with a vibrator assembly located at least partially in the area inside a nozzle of the casting apparatus, wherein the concrete mix is vibrated in the area inside the nozzle with the vibrator assembly performing only vertical vibrating motion.

9 Claims, 2 Drawing Sheets

(56) References Cited

U.S. PATENT DOCUMENTS 2,913,148 A * 11/1959 Charcuset ..... B65D 88/66 222/227
2,956,833 A * 10/1960 Morin ..... E04G 21/025 294/68.25
2,999,540 A * 9/1961 Bodine, Jr. ..... B01J 19/10 126/247
3,166,222 A * 1/1965 Schrader ..... B65D 88/66 222/195
3,215,209 A * 11/1965 Desvaux ..... E02D 9/02 173/49
3,289,898 A * 12/1966 Herman ..... B05C 1/04 118/231
3,353,720 A * 11/1967 Ricciardi ..... B01F 11/0088 222/200
3,377,001 A * 4/1968 Hazard ..... G01F 11/00 118/212
3,433,311 A * 3/1969 Lebelle ..... E02D 7/18 173/49
3,618,830 A * 11/1971 Bex ..... B65D 88/66 222/199
3,680,842 A * 8/1972 Sironi ..... B28B 1/0873 366/111
3,686,877 A * 8/1972 Bodin ..... E02D 7/18 173/49
3,688,653 A * 9/1972 McGregor ..... E01C 19/486 404/114
3,710,964 A * 1/1973 Douglass, Jr. ..... B65D 88/66 222/226
3,712,785 A * 1/1973 Hirt ..... B30B 11/022 264/102
3,743,468 A * 7/1973 Helmrich ..... B06B 1/16 425/421
3,853,247 A * 12/1974 Wahl ..... B65D 88/66 222/199
3,853,346 A * 12/1974 Jobst ..... B65D 90/626 294/68.25
4,050,527 A * 9/1977 Lebelle ..... B06B 1/166 173/49
4,291,753 A * 9/1981 Fisher ..... C22B 34/14 165/94
4,360,276 A * 11/1982 Jack ..... B01F 15/0298 366/101
4,470,524 A * 9/1984 Semenenko ..... B65D 88/66 222/196
4,472,091 A * 9/1984 Callahan ..... B01F 11/0258 222/196
4,545,509 A * 10/1985 Musschoot ..... B65D 88/66 222/181.1
5,375,926 A * 12/1994 Omasa ..... B01F 11/0082 366/118
5,652,002 A * 7/1997 Kobayashi ..... B06B 1/166 264/71
8,985,400 B2 * 3/2015 Swan ..... B24C 7/0069 222/1
2001/0038051 A1 * 11/2001 Okabe ..... B05B 7/1445 241/277
2015/0284922 A1 * 10/2015 Phelps ..... B65D 88/66 239/7

FOREIGN PATENT DOCUMENTS

| | | |
|---|---|---|
| EP | 0512776 | 1/1992 |
| FI | 121655 | 10/2010 |
| FR | 2611788 | 3/1987 |
| FR | 2648443 | 12/1990 |
| GB | 1195850 | 8/1967 |
| JP | H01240483 | 9/1989 |
| JP | 2001354324 | 12/2001 |
| RU | 2002687 C1 | 11/1993 |

OTHER PUBLICATIONS

Office Action cited in priority application FI 20145527 dated Feb. 2, 2015.

* cited by examiner

METHOD AND APPARATUS FOR CASTING CONCRETE PRODUCTS

This application claims benefit of Finnish Patent Application No. 20145527, filed 9 Jun. 2014, the entire contents of which are incorporated herein for all purposes.

BACKGROUND

1. Field

The present disclosure relates to casting of prefabricated concrete products by mold casting. More precisely the disclosure relates to a method and an apparatus for feeding concrete mix to a mold formed on a casting bed, such as a mold table for example.

2. Description of Related Art

When manufacturing concrete products by mold casting, the manufacturing process is started by first forming on the casting bed a mold that defines the measures of the product to be cast. Generally this is nowadays carried out by forming the mold on a metallic tiltable casting table of mold sidewall elements that are attached by means of magnets. When the mold defining the external measures of the mold is finished, inside the mold there are, when necessary, respectively formed areas bordered by sidewall elements, for example for windows, doors or other corresponding allocations defining the casting area of the cast product. Moreover, when necessary, various devices are placed on the casting table inside the mold for forming the required allocations, such as cardboard, provided with surface retarder, that is set on the casting table when casting graphic concrete. At the final stage of preparing the mold, it is provided with the necessary reinforcements, whereafter concrete mix is cast in the mold.

When casting concrete mix in a mold, it is generally fed from a concrete mix casting equipment moving above the mold. With a tilting mold, this casting of concrete mix in a mold is carried out from casting equipment located above the casting table, or brought above the casting table. When casting in a circulating mold line, a moving casting mold is generally brought to a vibrating station, which vibrating station is provided with casting equipment, and where the casting of concrete mix in a mold is carried out.

Possibly already during the casting of concrete mix, and not later than after the concrete mix has been cast in the mold, the mold filled with concrete mix is vibrated for compacting the concrete mix, and for ensuring that the mold is properly filled. With tilting molds, said vibration is realized for example by means of vibrators arranged in the casting table legs, and with a circulating mold line, in a vibrating station, where the concrete mix is cast in a mold, said vibrating station being provided with vibrators for vibrating the casting mold.

The concrete mix used in mold casting can be, for example, regular or self-compacting concrete. Various different color concrete mixtures can also be used as part of the element to be cast, or when necessary, the whole element can be cast in color concrete in order to obtain a desired color for the concrete to be cast.

Patent publication EP 0 512 776 specifies an apparatus used for casting concrete in a mold, where concrete mix is fed in a casting mold from a casting apparatus moving above the mold, said apparatus comprising a concrete mix storage tank and a nozzle connected thereto. The casting arrangement also comprises a vibrator for compacting and fluidizing the concrete mix to be cast prior to casting the concrete mix in the mold. In the arrangement described in said publication, the nozzle element is connected to the bottom of the concrete mix storage tank, and the nozzle unit is opened or closed, for respectively starting or ending the feeding of concrete mix, by a shutter element that is moved vertically by intermediation of a rod extending through the interiors of the nozzle element and the concrete mix storage tank.

SUMMARY

The drawback with the prior casting apparatuses, where the compaction of concrete mix takes place inside the nozzle with a vibrator against the inner surfaces of the nozzle, is that when casting stiff concrete mixes, the compacted concrete mix tends to stick to the inner surfaces of the nozzle, and thus obstructs the concrete mix mass flow, so that the casting speed of the casting apparatus significantly decreases.

The present invention, in an embodiment, provides a solution for casting stiff concrete mixes without the problem of blocked nozzle.

In an embodiment of the present invention, the vibrating motion of the vibrator assembly extending in the nozzle of the casting apparatus is changed from horizontal vibrating motion to only vertical vibrating motion which enhances the flow of concrete mix through the nozzle thus eliminating the drawbacks of the prior art casting machines when casting stiff concrete mixes.

In an embodiment of the method of the invention, for casting concrete products by mold casting, the concrete mix is fed in a casting mold from a casting apparatus moved above the mold, and the concrete mix is vibrated with a vibrator assembly located at least partially in the area inside a nozzle of the casting apparatus, wherein the concrete mix is vibrated in the area inside the nozzle with the vibrator assembly performing only vertical vibrating motion.

In an embodiment of the method of the invention, the vertical movement of concrete mix inside the nozzle is advantageously enhanced with protrusions located on the outer surface of the vibrator assembly.

In an embodiment of the method of the invention, the vibrating motion of the vibrator assembly may be low frequency motion with amplitude of 1-2 Hz and stroke of 3-10 mm for example, or the vibrating motion may be high frequency motion with amplitude of 50-60 Hz and stroke of 0.1-2 mm for example.

The apparatus of the invention for casting concrete products by mold casting, in an embodiment, is movable above a casting mold for feeding concrete mix in the casting mold, and comprises a concrete mix container, a nozzle connected to the bottom of the concrete mix container, the area inside the nozzle defining a casting duct, and a vibrator assembly located at least partially at the area inside the nozzle, wherein the vibrator assembly is adapted to perform only vertical vibrating motion.

In an embodiment of the apparatus of the invention, the outer surface of the vibrator assembly is advantageously equipped with protrusions in the area located inside the nozzle. These protrusions are preferably located on the outer surface of the vibrator assembly asymmetrically around the horizontal cross-section of the vibrator assembly.

In an embodiment of the apparatus of the invention, the surface of the vibrator assembly located inside the nozzle is advantageously formed serrated, and/or serrated protrusions are advantageously formed on the outer surface of the vibrator assembly located inside the nozzle, for enhancing the downwards movement of concrete mix inside the nozzle.

In an embodiment of the apparatus of the invention, the vibrator assembly extends advantageously also in the area of the concrete mix container, and have a widening cross-section at least in part of the length of the vibrator assembly located in the area of the concrete mix container.

In an embodiment of the apparatus of the invention, the vibrating motion of the vibrator assembly may be low frequency motion with amplitude of 1-2 Hz and stroke of 3-10 mm for example, or the vibrating motion may be high frequency motion with amplitude of 50-60 Hz and stroke of 0.1-2 mm for example.

In an embodiment of the apparatus of the invention, the vibrator assembly advantageously comprises a plurality of rotatable eccentrics, either separate or rotatably connected to each other, for obtaining the only vertical vibrating motion. Further, the vibrator assembly may comprise a plurality of eccentric pairs, preferably even amount of eccentric pairs, where one eccentric rotates twice as fast as the other in order to increase the vibratory force in the desired direction. These kinds of vibrators are known from patent publication Fl 121655.

The features of the method according to an embodiment of the invention are, more precisely, a method for casting concrete products by mold casting, where concrete mix is fed in a casting mold from a casting apparatus moved above the mold, and the concrete mix is vibrated with a vibrator assembly located at least partially in the area inside a nozzle of the casting apparatus, characterized in that the concrete mix is vibrated in the area inside the nozzle with the vibrator assembly performing only vertical vibrating motion. The features of the apparatus according to an embodiment of the invention are, more precisely, an apparatus for casting concrete products by mold casting, which apparatus is movable above a casting mold for feeding concrete mix in the casting mold, the apparatus comprising a concrete mix container, a nozzle connected to the bottom of the concrete mix container, the area inside the nozzle defining a casting duct, and a vibrator assembly located at least partially at the area inside the nozzle, characterized in that the vibrator assembly is adapted to perform only vertical vibrating motion.

In a more particular embodiment, the vertical movement of concrete mix inside the nozzle is enhanced with protrusions located on the outer surface of the vibrator assembly.

In a more particular embodiment, the vertical vibrating motion has amplitude of 1-2 Hz, and stroke of 3-10 mm.

In a more particular embodiment, the vertical vibrating motion has amplitude of 50-60 Hz, and stroke of 0.1-2 mm.

In a more particular embodiment, the outer surface of the vibrator assembly is equipped with protrusions in the area located inside the nozzle.

In a more particular embodiment, the protrusions are located on the outer surface of the vibrator assembly asymmetrically around the horizontal cross-section of the vibrator assembly.

In a more particular embodiment, the surface of the vibrator assembly located inside the nozzle is formed serrated, and/or serrated protrusions are formed on the outer surface of the vibrator assembly located inside the nozzle, for enhancing the downwards movement of concrete mix inside the nozzle.

In a more particular embodiment, the vibrator assembly extends in the area of the concrete mix container, and have a widening cross-section at least in part of the length of the vibrator assembly located in the area of the concrete mix container.

In a more particular embodiment, the vibrator assembly comprises a plurality of rotatable eccentrics, either separate or rotatably connected to each other, for obtaining the only vertical vibrating motion.

BRIEF DESCRIPTION OF DRAWINGS

The invention, in its embodiments, is discussed in greater detail in the sense of example below and with reference to accompanying drawings, where.

DETAILED DESCRIPTION OF SPECIFIC EMBODIMENTS

In the figures, concrete mix containers and related nozzles and other to these fixedly connected parts are shown in vertical cross-section in order to show the construction of the vibrator assemblies located partially inside the concrete mix containers and the nozzles.

Figure 1:
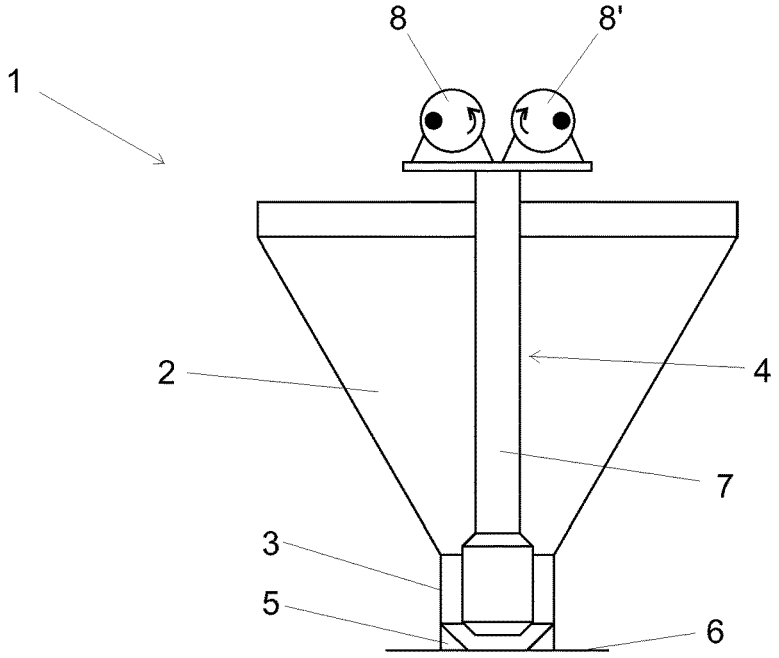
FIG. 1 shows schematically an embodiment of a casting apparatus of the invention.

The casting apparatus 1 of the invention shown schematically in FIG. 1 comprises a concrete mix container 2, a nozzle 3 connected to the bottom of the concrete mix container and defining a casting duct of the casting apparatus, and a vibrator assembly 4. At the bottom area of the inner surface of the nozzle 3 is formed a protrusion 5 circling the nozzle and defining casting opening of the casting apparatus 1, against which protrusion the vibrator assembly 4 is lowered for preventing concrete mix to exit the nozzle when ending the casting process. At the bottom of the nozzle 3, circling the nozzle or the casting opening is connected a leveling plate 6, which is used to level the upper surface of the concrete product to be cast during casting process.

The vibrator assembly 4 comprises vibrator shaft 7 extending vertically through the concrete mix container 2 and in the area inside the nozzle 3 for conveying vibration effect to the area inside the nozzle, and two vibrators 8, 8' for creating the vibration effect for the vibrator assembly. The two vibrators 8, 8' rotate their eccentrics in opposite rotation directions synchronously in order to provide only vertical vibrational effect. The vibrator shaft 7 have widened cross-section in the area inside the nozzle 3 in order to enhance the vibratory effect in the area inside the nozzle.

Figure 2A:
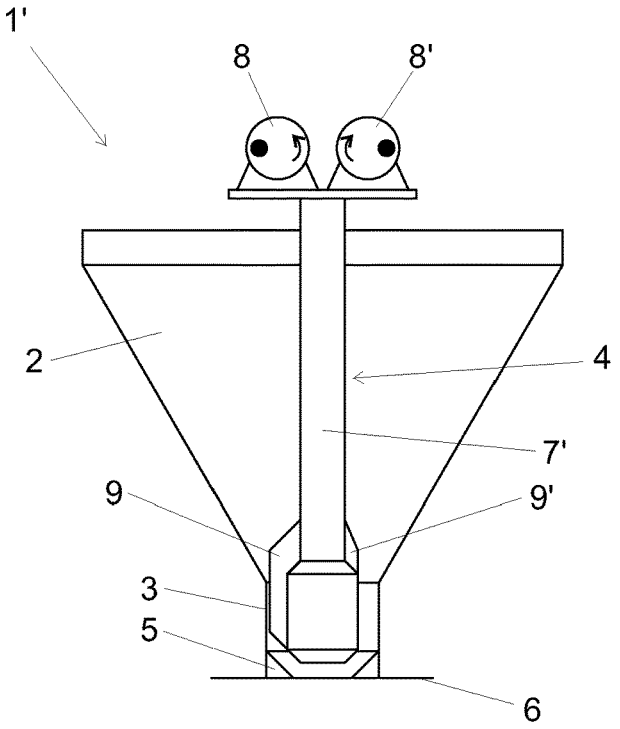
FIGS. 2A and 2B show schematically an alternative embodiment of a casting apparatus of the invention.
Figure 2B:
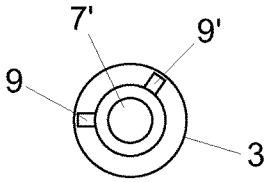

FIGS. 2A and 2B show schematically an alternatively embodiment of a casting apparatus 1' of the invention, which is otherwise similar than the one disclosed in FIG. 1 with the exception of the construction of the vibrator shaft 7'. FIG. 2A shows a similar side view of the casting apparatus 1' as FIG. 1, and FIG. 2 shows the vibrator shaft 7' from below inside the nozzle 3 without the protrusion 5 and the leveling plate 6.

In the embodiment of FIGS. 2A and 2B, the vibrator shaft 7' is equipped with protrusions 9, 9', which are connected to the outer surface of the vibrator shaft 7' asymmetrically. These protrusions 9, 9' prevent concrete mix from forming a continuous compacted sleeve-like block against the inner surface of the nozzle 3. This prevention effect is further enhanced with the asymmetric placement of the protrusions 9, 9'.

Figure 3:
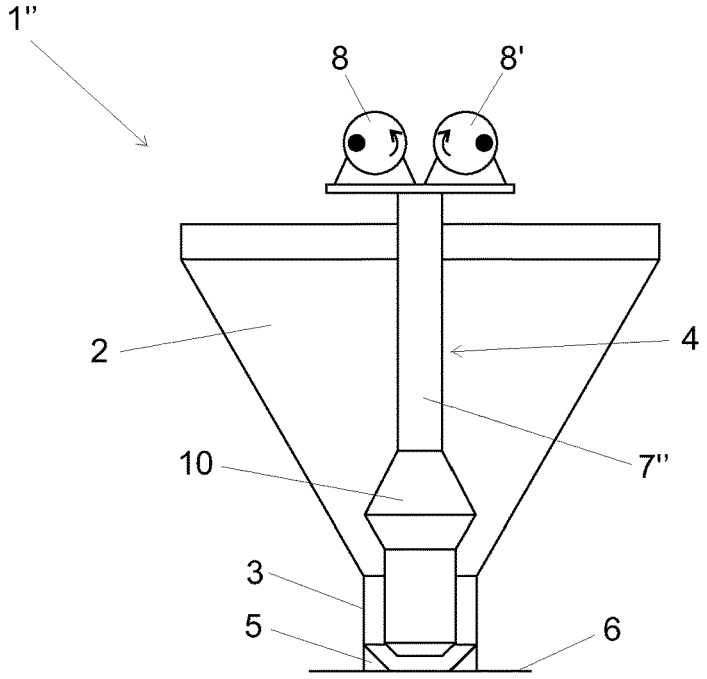
FIG. 3 shows schematically another alternative embodiment of a casting apparatus of the invention.

FIG. 3 shows schematically another alternative embodiment of a casting apparatus 1" of the invention, which is otherwise similar than the ones disclosed in FIG. 1 and FIGS. 2A and 2B with the exception of the construction of the vibrator shaft 7".

In the embodiment of FIG. 3, the vibrator shaft 7" comprises a widened portion 10 located in the area inside the concrete mix container 2. This widened portion 10 enhances the feed of concrete mix to and through the nozzle 3 and the casting opening of the casting apparatus 1".

Figure 4:
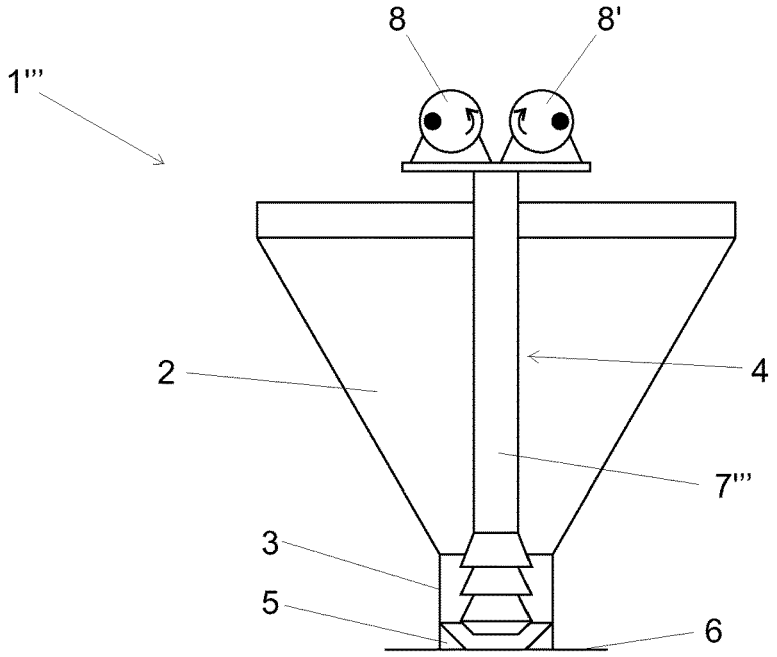
FIG. 4 shows schematically another alternative embodiment of a casting apparatus of the invention.

FIG. 4 shows schematically yet another alternative embodiment of a casting apparatus 1'" of the invention, which is otherwise similar than the one previously discussed with the exception of the construction of the vibrator shaft 7'".

In this embodiment, the surface of the vibrator shaft 7'" located inside the nozzle 3 area is formed serrated. The serrated surface enhances the downwards movement of concrete mix inside the nozzle 3 due to the vertical vibrating movement of the vibrator shaft 7'" and thus "forces" the concrete mix from the nozzle though casting opening to the casting mold.

In relation to the features of vibrator shafts of the above discussed embodiments, it is to be noted that two or more of the disclosed features may be combined with each other. For example, a vibrator shaft can include the protrusions 9, 9' and the widened portion 10 with or without serrated sections.

The specific exemplifying embodiments of the invention shown in the figures and discussed above should not be construed as limiting. A person skilled in the art can amend and modify the embodiments in many evident ways within the scope of the attached claims. Thus the invention is not limited merely to the embodiments described above.

The invention claimed is:

1. A method for casting concrete products by mold casting, comprising:

feeding concrete mix in a casting mold from a casting apparatus moved above the mold wherein the casting apparatus comprises a concrete mix container and a nozzle connected to a bottom of the concrete mix container, wherein an area inside the nozzle defines a casting duct, and vibrating the concrete mix with a vibrator assembly located at least partially in the area inside the nozzle of the casting apparatus, wherein the concrete mix is vibrated in the area inside the nozzle with the vibrator assembly performing only a vertical vibrating motion and vertical movement of concrete mix inside the nozzle is enhanced with protrusions located on an outer surface of the vibrator assembly in the area located inside the nozzle, or a surface of the vibrator assembly located inside the nozzle is formed serrated for enhancing downwards movement of concrete mix inside the nozzle.

2. The method according to claim 1, wherein the vertical vibrating motion has amplitude of 1-2 Hz, and stroke of 3-10 mm.

3. The method according to claim 1, wherein the vertical vibrating motion has amplitude of 50-60 Hz, and stroke of 0.1-2 mm.

4. An apparatus for casting concrete products by mold casting, which apparatus is movable above a casting mold for feeding concrete mix in the casting mold, the apparatus comprising:

a concrete mix container, a nozzle connected to a bottom of the concrete mix container, wherein an area inside the nozzle defines a casting duct, and a vibrator assembly located at least partially in the area inside the nozzle, wherein the vibrator assembly is adapted to perform only vertical vibrating motion and an outer surface of the vibrator assembly is equipped with protrusions in the area located inside the nozzle, or a surface of the vibrator assembly located inside the nozzle is formed serrated for enhancing downwards movement of concrete mix inside the nozzle.

5. The apparatus according to claim 4, wherein the protrusions are located on the outer surface of the vibrator assembly asymmetrically around a horizontal cross-section of the vibrator assembly.

6. The apparatus according to claim 4, wherein the vibrator assembly extends into an area of the concrete mix container, and has a widening cross-section at least in part of a length of the vibrator assembly located in the area of the concrete mix container.

7. The apparatus according to claim 4, wherein the vibrating motion has amplitude of 1-2 Hz, and stroke of 3-10 mm.

8. The apparatus according to claim 4, wherein the vibrating motion has amplitude of 50-60 Hz, and stroke of 0.1-2 mm.

9. The apparatus according to claim 4, wherein the vibrator assembly comprises a plurality of rotatable eccentrics, either separate or rotatably connected to each other, for obtaining the only vertical vibrating motion.

* * * * *